US008629891B2

(12) United States Patent
Hozumi

(10) Patent No.: US 8,629,891 B2
(45) Date of Patent: Jan. 14, 2014

(54) THERMAL PRINTER AND PROTECTION COAT PRINT METHOD

(71) Applicant: Canon Kabushiki Kaisha, Tokyo (JP)

(72) Inventor: Yasushi Hozumi, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/751,851

(22) Filed: Jan. 28, 2013

(65) Prior Publication Data

US 2013/0201269 A1 Aug. 8, 2013

(30) Foreign Application Priority Data

Feb. 2, 2012 (JP) ..... 2012-021341

(51) Int. Cl.
*B41J 2/38* (2006.01)
*B41J 29/38* (2006.01)
*B41J 2/01* (2006.01)

(52) U.S. Cl.
USPC ..... 347/187; 347/16; 347/101

(58) Field of Classification Search
USPC ..... 347/14, 16, 101, 105, 106, 187
See application file for complete search history.

(56) References Cited

U.S. PATENT DOCUMENTS

| | | | | |
|---|---|---|---|---|
| 8,068,126 | B2 * | 11/2011 | Busch et al. | 347/187 |
| 2003/0001939 | A1 * | 1/2003 | Scofield et al. | 347/105 |
| 2004/0135836 | A1 * | 7/2004 | Nunokawa | 347/16 |
| 2004/0141042 | A1 * | 7/2004 | Silverbrook | 347/101 |
| 2011/0157272 | A1 * | 6/2011 | Ikehata et al. | 347/16 |

FOREIGN PATENT DOCUMENTS

| | | |
|---|---|---|
| JP | 3861293 | 12/2006 |
| WO | 97/39898 | 10/1997 |

* cited by examiner

*Primary Examiner* — Kristal Feggins
(74) *Attorney, Agent, or Firm* — Cowan, Liebowitz & Latman, P.C.

(57) ABSTRACT

A thermal printer comprises a print unit which prints an image and forms a protection coat layer on a printed image, a designation unit which designates a glossy print mode or a matte print mode, and a control unit which controls the print unit, when the designation unit designates the glossy print mode, the control unit controls the print unit to execute printing of the protection coat layer without performing any preheating process, and when the designation unit designates the matte print mode, the control unit controls the print unit to perform the preheating process, and to then execute printing of the protection coat layer.

8 Claims, 14 Drawing Sheets

FIG. 4

THRESHOLD TEMPERATURE Tth

| INTERNAL TEMPERATURE Tenv | MATTE PATTERN (i) | | | MATTE PATTERN (ii) | | |
|---|---|---|---|---|---|---|
| | MATTE STATE (VAGUE) | MATTE STATE (MEDIUM) | MATTE STATE (SHARP) | MATTE STATE (VAGUE) | MATTE STATE (MEDIUM) | MATTE STATE (SHARP) |
| 10 | 30 | 40 | 50 | 35 | 45 | 55 |
| ⋮ | ⋮ | ⋮ | ⋮ | ⋮ | ⋮ | ⋮ |
| 25 | PREHEATING NOT REQUIRED | 35 | 45 | WITHOUT PREHEATING | 40 | 50 |
| ⋮ | ⋮ | ⋮ | ⋮ | ⋮ | ⋮ | ⋮ |
| 40 | PREHEATING NOT REQUIRED | PREHEATING NOT REQUIRED | PREHEATING NOT REQUIRED | PREHEATING NOT REQUIRED | PREHEATING NOT REQUIRED | 45 |

MATTE PATTERN (i)

MATTE PATTERN (ii)

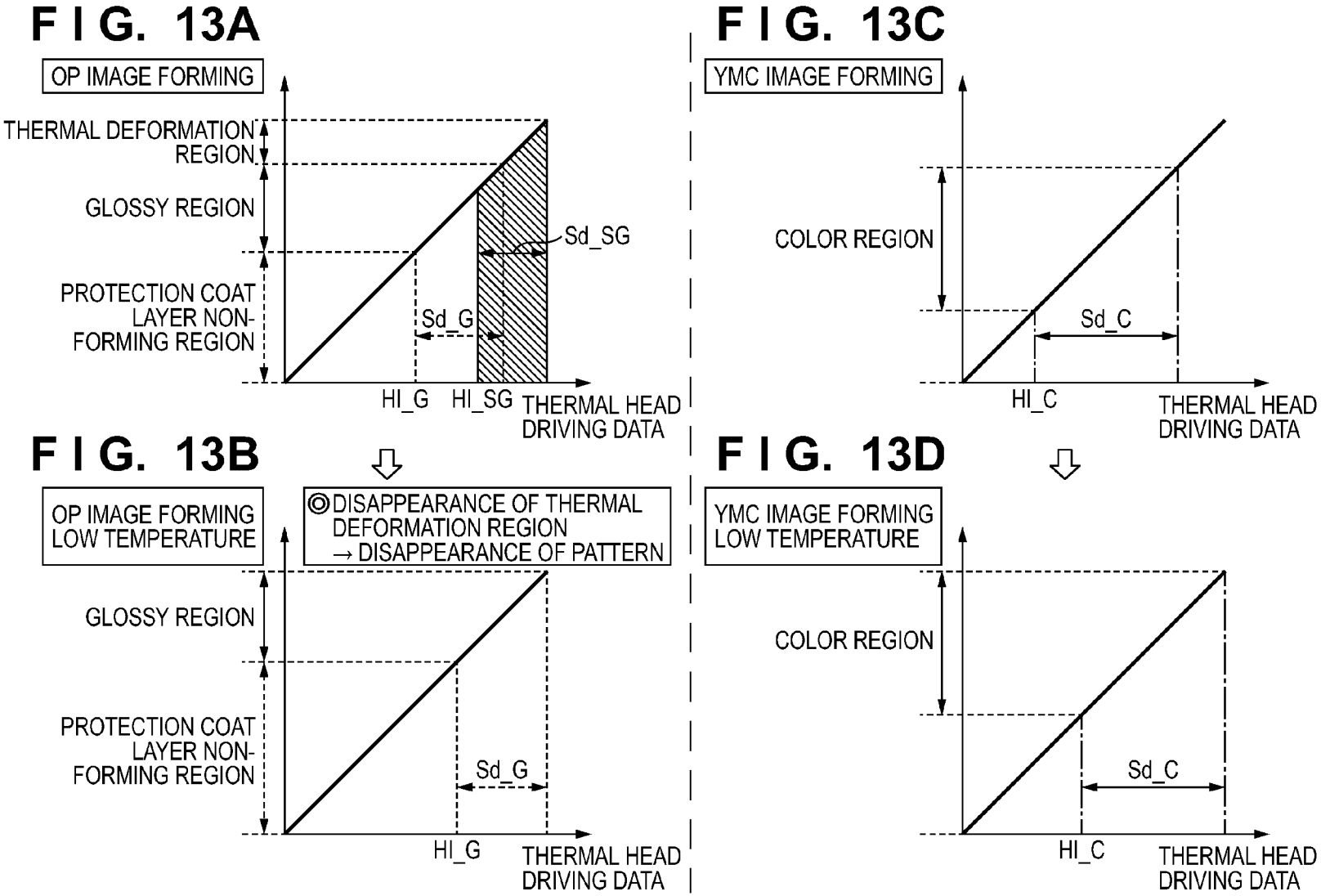
FIG. 13A
OP IMAGE FORMING
THERMAL DEFORMATION REGION
GLOSSY REGION
PROTECTION COAT LAYER NON-FORMING REGION
Sd_SG
Sd_G
HI_G
HI_SG
THERMAL HEAD DRIVING DATA
FIG. 13B
OP IMAGE FORMING LOW TEMPERATURE
◎DISAPPEARANCE OF THERMAL DEFORMATION REGION → DISAPPEARANCE OF PATTERN
GLOSSY REGION
PROTECTION COAT LAYER NON-FORMING REGION
Sd_G
HI_G
THERMAL HEAD DRIVING DATA
FIG. 13C
YMC IMAGE FORMING
COLOR REGION
Sd_C
HI_C
THERMAL HEAD DRIVING DATA
FIG. 13D
YMC IMAGE FORMING LOW TEMPERATURE
COLOR REGION
Sd_C
HI_C
THERMAL HEAD DRIVING DATA

FIG. 14A YMC IMAGE FORMING TEMPERATURE CORRECTION TABLE

THERMAL HEAD TEMPERATURE Thead

| INTERNAL TEMPERATURE Tenv | a1 | a2 | … | am |
|---|---|---|---|---|
| b1 | Sd_C(11)<br>Hl_C(11) | Sd_C(21)<br>Hl_C(21) | … | Sd_C(m1)<br>Hl_C(m1) |
| b2 | Sd_C(12)<br>Hl_C(12) | Sd_C(22)<br>Hl_C(22) | … | Sd_C(m2)<br>Hl_C(m2) |
| ⋮ | ⋮ | ⋮ | | ⋮ |
| bn | Sd_C(1n)<br>Hl_C(1n) | Sd_C(2n)<br>Hl_C(2n) | … | Sd_C(mn)<br>Hl_C(mn) |

Thead : $a1<a2<a3 \cdots <a_{m-1}<a_m$
Tenv : $b1<b2<b3 \cdots <b_{n-1}<b_n$

FIG. 14B GLOSSY IMAGE FORMING TEMPERATURE CORRECTION TABLE

THERMAL HEAD TEMPERATURE Thead

| INTERNAL TEMPERATURE Tenv | a1 | a2 | … | am |
|---|---|---|---|---|
| b1 | Sd_G(11)<br>Hl_G(11) | Sd_G(21)<br>Hl_G(21) | … | Sd_G(m1)<br>Hl_G(m1) |
| b2 | Sd_G(12)<br>Hl_G(12) | Sd_G(22)<br>Hl_G(22) | … | Sd_G(m2)<br>Hl_G(m2) |
| ⋮ | ⋮ | ⋮ | | ⋮ |
| bn | Sd_G(1n)<br>Hl_G(1n) | Sd_G(2n)<br>Hl_G(2n) | … | Sd_G(mn)<br>Hl_G(mn) |

FIG. 14C MATTE IMAGE FORMING TEMPERATURE CORRECTION TABLE

THERMAL HEAD TEMPERATURE Thead

| INTERNAL TEMPERATURE Tenv | a1 | a2 | … | am |
|---|---|---|---|---|
| b1 | IMPOSSIBLE TO SET | IMPOSSIBLE TO SET | … | Sd_SG(m1)<br>Hl_SG(m1) |
| b2 | IMPOSSIBLE TO SET | Sd_SG(22)<br>Hl_SG(22) | … | Sd_SG(m2)<br>Hl_SG(m2) |
| ⋮ | ⋮ | ⋮ | | ⋮ |
| bn | Sd_SG(1n)<br>Hl_SG(1n) | Sd_SG(2n)<br>Hl_SG(2n) | … | Sd_SG(mn)<br>Hl_SG(mn) |

THERMAL PRINTER AND PROTECTION COAT PRINT METHOD

BACKGROUND OF THE INVENTION

1. Field of the Invention

The present invention relates to a thermal printer and projection coat print method, particularly relates to a technique for forming a protection coat on an image printed by a thermal printer.

2. Description of the Related Art

A thermal printer selectively drives a plurality of heat generating members arrayed in a main-scanning direction, and conveys an ink sheet and printing medium in a sub-scanning direction, thereby thermally transferring or sublimating ink in a dot line pattern on the printing paper to attain image forming.

Since the thermal printer can easily change a heat amount required to control a density of one pixel, it can relatively easily reproduce multi-tonality for one pixel, thus obtaining a smooth, high-quality image. A recent thermal printer can print an image having as high finishing quality as a silver halide photo since the performance of a thermal head and a material of printing paper are improved.

As for a technique for forming a protection coat layer on a printed image using this thermal printer, Japanese Patent No. 3861293 is known. Japanese Patent No. 3861293 describes a thermal printer which performs an image forming operation on a protection coat layer (laminate film) using a plurality of types of image forming data to form concaves/convexes on the surface of a printed material, thus realizing a matte finish (or matte finish).

However, the matte protection coat layer of a printed material by Japanese Patent No. 3861293 does not always have stable finish qualities, and as a result of dedicated examinations of the present inventors, it was revealed that the matte finish changed depending on print environments. Particularly, a thermal head temperature and environmental temperature (printer internal temperature) have great influences, and at especially a low temperature, a matte protection coat layer cannot often be formed.

SUMMARY OF THE INVENTION

The present invention has been made in consideration of the aforementioned problems, and realizes a thermal printer and a protection coat print method which can stably form a matte protection coat layer on a printed material independently of temperature environments without deteriorating image quality.

In order to solve the aforementioned problems, the present invention provides a thermal printer for printing an image by transferring an ink onto a printing medium, comprising: a print unit configured to print an image by transferring the ink onto the printing medium, and to form a protection coat layer on the printed image; a designation unit configured to designate a glossy print mode or a matte print mode as a print mode required to form the protection coat layer; and a control unit configured to control the print unit according to the print mode designated by the designation unit, wherein when the designation unit designates the glossy print mode, the control unit controls the print unit to execute printing of the protection coat layer without performing any preheating process, and when the designation unit designates the matte print mode, the control unit controls the print unit to perform the preheating process, and to then execute printing of the protection coat layer.

In order to solve the aforementioned problems, the present invention provides a protection coat print method in a thermal printer, which forms an image by transferring an ink onto a printing medium, and forms a protection coat layer on the printed image, comprising: a designation step of designating a glossy print mode or a matte print mode as a print mode required to form the protection coat layer; and a control step of controlling a thermal head according to the print mode designated in the designation step, wherein in the control step, when the glossy print mode is designated in the designation step, the thermal head is controlled to execute printing of the protection coat layer without performing any preheating process, and when the matte print mode is designated in the designation step, the thermal head is controlled to perform the preheating process, and to then execute printing of the protection coat layer.

According to the present invention, a matte protection coat layer can be stably formed on a printed material independently of temperature environments without deteriorating image quality.

Further features of the present invention will become apparent from the following description of exemplary embodiments (with reference to the attached drawings).

BRIEF DESCRIPTION OF THE DRAWINGS

FIG. 4 shows an example of a threshold temperature table according to the embodiment;

FIGS. 13A to 13D are views showing thermal head driving data and print regions in a protection coat image forming and YMC image forming; and FIGS. 14A to 14C show examples of temperature correction tables in a YMC image forming and OP image forming.

DESCRIPTION OF THE EMBODIMENTS

A mode for carrying out the present invention will be described in detail hereinafter. Note that an embodiment to be described hereinafter is an example required to implement the present invention and should be modified or changed as needed depending on configurations of apparatus and various conditions to which the present invention is applied, and the present invention is not limited to the following embodiment. Some of embodiments to be described later may be combined as needed.

Note that in the following description, "printing" indicates a series of overall operations from an image forming operation based on a printing instruction from the user until a paper discharge operation. Also, "image forming" indicates an operation for recording an image on a printing medium such as printing paper by thermally transferring an ink applied on an ink sheet to the printing paper of the print operations.

A protection coat print method using a thermal transfer or sublimation type thermal printer will be described hereinafter. However, the present invention is not limited to a printer alone, but is applicable to, for example, a copying machine, facsimile apparatus, computer system, and the like as long as they include apparatuses having an image forming function of this embodiment.

<Apparatus Configuration>

A principal configuration of a thermal printer of this embodiment will be described below with reference to FIG. 8.

Figure 8:
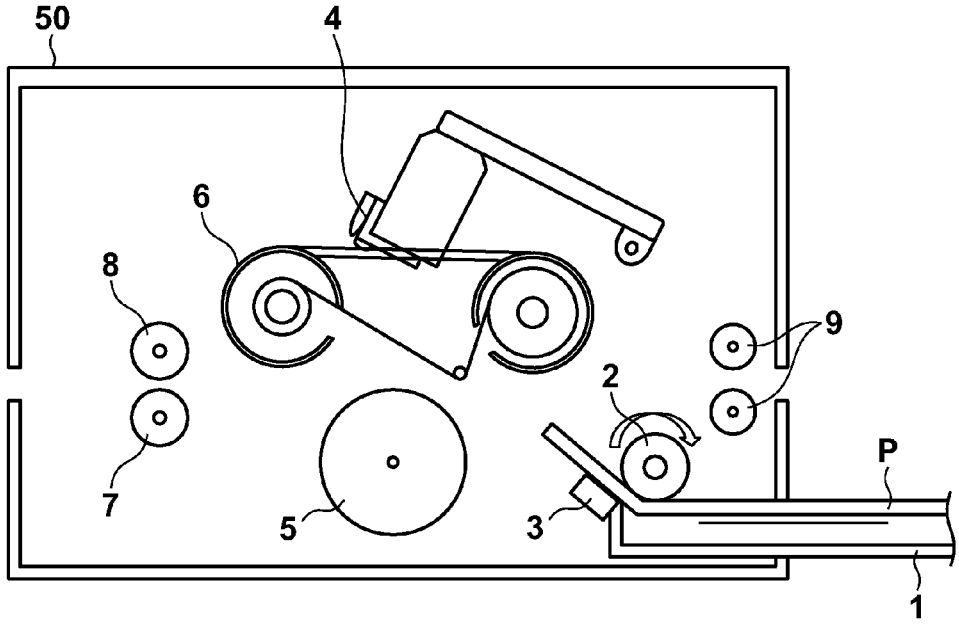
FIG. 8 is a view for explaining a paper feed operation by the thermal printer according to the embodiment.

Referring to FIG. 8, the thermal printer of this embodiment performs a print operation by mounting, to a printer main body 50, a detachable printing paper cassette 1 in which printing paper sheets P are stacked, and a detachable ink sheet 6.

In the printer main body 50, a thermal head 4 and platen roller 5 are disposed via the printing paper P and ink sheet 6, and the thermal head 4 is moved to approach the platen roller 5 side in a print operation. At this time, the thermal head 4 and platen roller 5 are respectively mounted so that the longitudinal direction of the thermal head 4 is substantially parallel to the rotation axis of the platen roller 5.

This embodiment exemplifies an arrangement in which the platen roller 5 is fixed to a base frame of the printer main body 50, and the thermal head 4 is movable. However, the present invention is not limited to this. That is, the present invention is applicable to a case in which the thermal head 4 is fixed to the base frame of the printer main body 50, and the platen roller 5 is movable or a case in which both the thermal head 4 and platen roller 5 are movable.

The printer main body 50 includes a feed roller 2 and separation unit 3 as a mechanism for feeding only an uppermost one of printing paper sheets stacked in the printing paper cassette 1. Thus, only an uppermost sheet of printing paper is separated and fed, and is conveyed to the thermal head 4 and platen roller 5.

As a mechanism for conveying a printing paper sheet at a predetermined speed in an image forming operation, a grip roller 7 and pitch roller 8 are arranged. By rotating the grip roller 7 at a uniform speed by a motor (not shown), the printing paper sheet P is gripped by small projections formed on the grip roller 7, thereby conveying the printing paper. Convey directions of the printing paper include two different directions, that is, a direction in the image forming operation, and a direction for drawing back the printing paper to an image forming start position before the next image forming operation. These directions are opposite convey directions.

Furthermore, the printer main body 50 includes a paper discharge roller pair 9 used to discharge a printed material outside of the apparatus. A lower roller of the paper discharge roller pair 9 is rotated in a paper discharge direction by a motor (not shown), thereby discharging a printed material outside of the printer main body 50.

The outer appearance and a user interface of the thermal printer of this embodiment will be described below with reference to FIG. 5.

Figure 5:
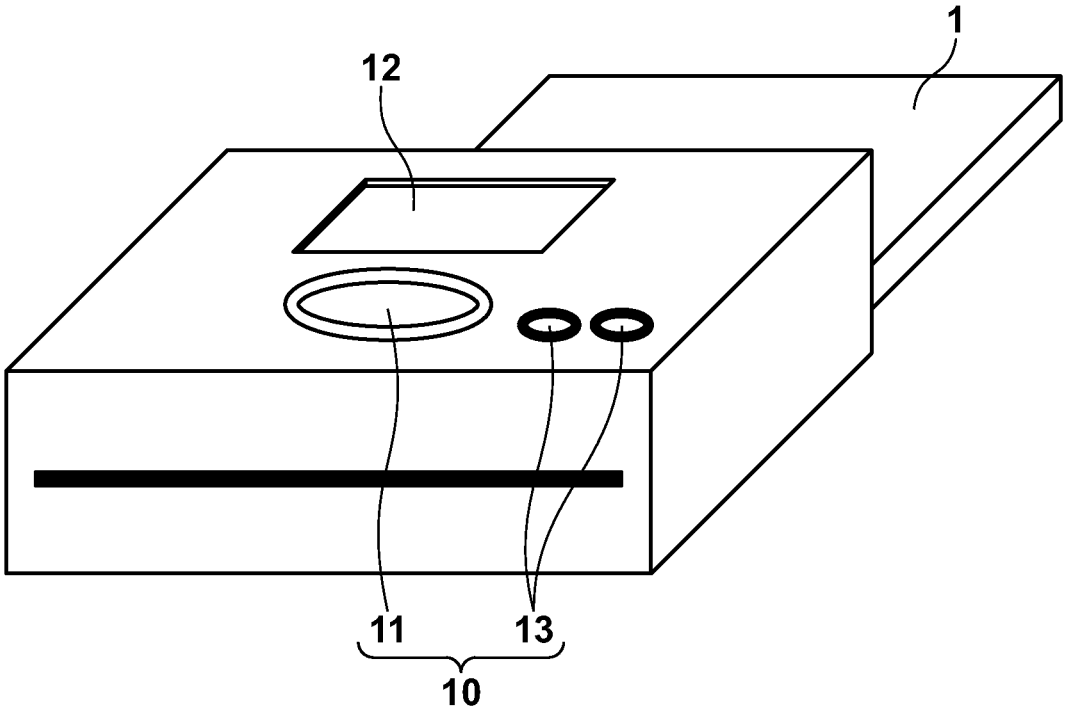
FIG. 5 is a view showing the outer appearance of the thermal printer according to the embodiment.

Referring to FIG. 5, an operation unit 10 can set various print commands by user operations. A display unit 12 displays image data and a menu and the like used to input setting data required for printing. Mainly, these two functions form a user interface of the thermal printer of this embodiment. Details of the operation unit 10 will be described later.

<Functional Configuration>

The functional configuration of a thermal printer 100 will be described below with reference to FIG. 6.

Figure 6:
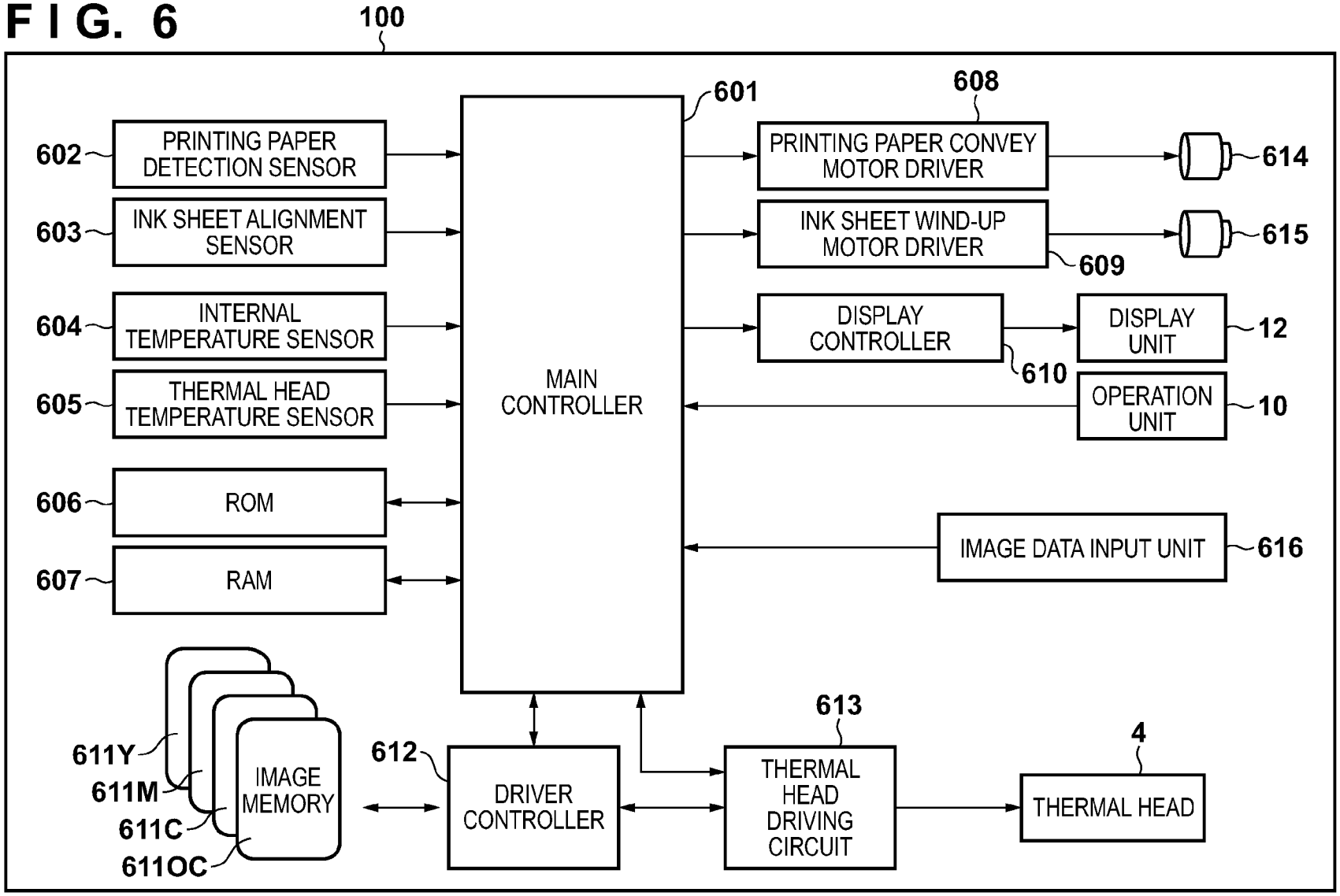
FIG. 6 is a block diagram showing the configuration of the thermal printer according to the embodiment.

Referring to FIG. 6, reference numeral 601 denotes a main controller which controls the overall printer 100. Reference numeral 602 denotes a printing paper detection sensor which is arranged in the vicinity of the paper feed roller 2, and detects whether or not the leading end portion of printing paper P fed from the printing paper cassette 1 is discharged.

The main controller 601 determines, using the printing paper detection signal, that a timing after an elapse of a predetermined time period according to a printing paper size since that detection timing is a print start timing, and drives the thermal head 4 at that print start timing to start an image forming.

Reference numeral 603 denotes an ink sheet alignment sensor, which detects an identification band applied to the leading end portion of each of Y, M, and C colors of the ink sheet. A wind-up operation of the ink sheet by an ink sheet wind-up motor 615 is controlled based on the detection result of the ink sheet alignment sensor 603.

Reference numerals 604 and 605 denote an internal temperature sensor and thermal head temperature sensor, which respectively detect an internal ambient temperature of the printer and the temperature of the thermal head 4.

An application energy (that based on thermal head driving data) applied by a thermal head 4 driving circuit 613 is controlled based on the detection results of the internal temperature sensor 604 and thermal head temperature sensor 605.

In this embodiment, at least one of necessity of a preheating process, a preheating temperature (threshold temperature), and a preheating time is determined using the detection results of the internal temperature sensor 604 and thermal head temperature sensor 605.

Reference numeral 606 denotes a ROM (storage unit), which is connected to the main controller 601 and stores a control program and the like. The main controller 601 operates according to the control program stored in the ROM 606.

In an image forming operation, temperature correction data Hl and Sd, which are determined for each ink sheet and print mode, as shown in FIGS. 14A to 14C, are read out from the ROM 606 based on the detection results of the temperature sensors 604 and 605, and are temporarily stored in a RAM 607.

The RAM 607 is used as a work memory for arithmetic processes of the main controller 601, and also temporarily stores various setting data input via the operation unit 10.

The main controller 601 converts image data input from an image data input unit 616 or that stored in the ROM 606 into thermal head driving data using the temperature correction data Hl and Sd, which are read out from the ROM 606 and are stored in the RAM 607.

Then, the main controller 601 drives a driver controller 612, the thermal head driving circuit 613, and the thermal head 4 according to that thermal head driving data to perform an image forming, thereby generating a desired printed material.

In addition to the image forming operation, control programs required to set a print mode, to execute a preheating process sequence accordingly, and the like are stored in the ROM 606. Details will be described later.

Reference numeral 608 denotes a convey motor driver required to drive a driving motor 614. The driving motor 614 is coupled to the paper feed roller 2, grip roller 7, paper discharge roller 9, and the like via a rotation mechanism, and drives these rollers, thereby conveying printing paper.

Reference numeral 609 denotes an ink sheet wind-up motor driver, which controls rotation of the ink sheet wind-up motor 615. In a state in which the ink sheet 6 is attached, since an ink sheet take-up roller (not shown) and the ink sheet wind-up motor 615 are coupled via a rotation mechanism, ink sheet take-up and wind-up operations are controlled by the ink-sheet wind-up motor driver 609.

Reference numeral 610 denotes a display controller, which displays image data to be printed, and a menu used to input setting data required for printing on the display unit 12.

Reference numerals 611Y, 611M, 611C, and 611OC denote image buffers which store image data received via the image data input unit 616 or ROM 606. Reference numeral 611Y denotes a yellow image buffer which temporarily stores yellow image data; and 611M, 611C, and 611OC, image buffers which respectively store magenta, cyan, and protection coat layer image data.

Image data stored in the image buffers 611Y, 611M, and 611C of the image data of the respective colors are different from image data stored in the image buffer 611OC of the protection coat layer image data. The former image data are those required to perform full-color printing, and the latter is image data required to print a glossy, matte, or arbitrary pattern on the surface of a printed material on which an image is formed.

Reference numeral 613 denotes a thermal head driving circuit which drives heat generating members included in the thermal head 4. The driver controller 612 connected to the main controller 601 controls the thermal head driving circuit 613 using image data recorded in a bitmap format in the image buffers 611Y to 611OC, thereby performing an image forming.

The main controller 601 converts image data in the image buffers 611Y to 611OC into thermal head driving data, and the driver controller 612 controls the thermal head driving circuit 613 according to the thermal head driving data, thus performing an image forming.

<Print Operation>

A basic print operation of the thermal printer of this embodiment will be described below with reference to FIG. 2.

Figure 2:
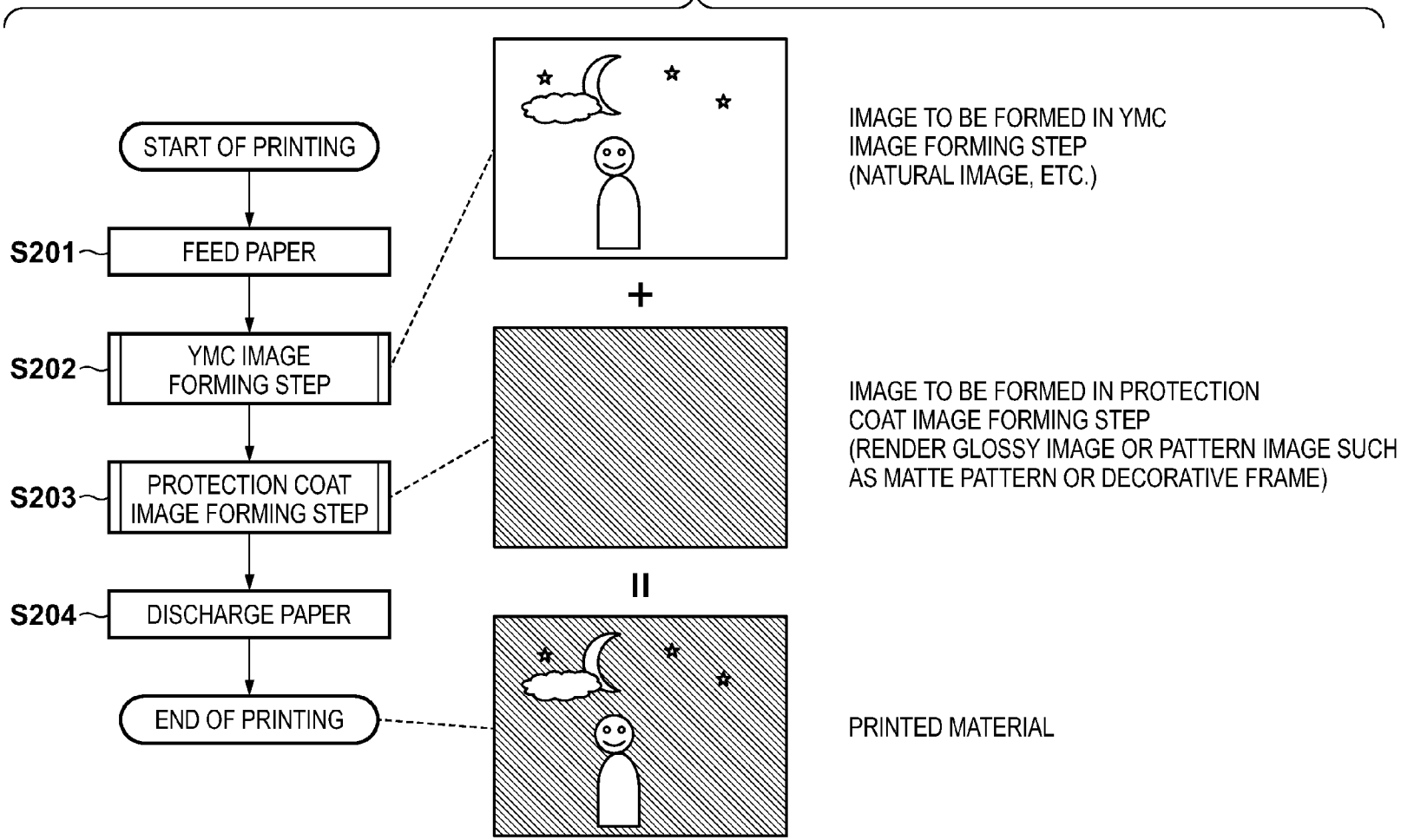
FIG. 2 shows a flowchart showing a print operation by the thermal printer according to the embodiment and image data to be handled in respective steps.

Note that the processing shown in FIG. 2 is implemented when the main controller 601 extracts the control program stored in the ROM 606 onto a work area of the RAM 607 and executes the extracted program.

Referring to FIG. 2, when the user presses a print start button 11 (see FIG. 5), the main controller 601 performs a paper feed step of feeding a printing paper sheet to an image forming portion (a region where the thermal head 4 and platen roller 5 contact in an image forming operation) (step S201).

Next, the main controller 601 performs a YMC image forming step of performing an image forming using ink sheet portions of respective colors (step S202). Step S202 is that of performing an image forming of a full-color natural image or the like such as an "image to be formed in YMC image forming step" shown on the right side of step S202 in FIG. 2, and an image is formed by the same method as in the convectional thermal printer.

Next, the main controller 601 performs a protection coat image forming step of performing an image forming on the image using an ink sheet portion of the protection coat layer (step S203). In step S203, a glossy image or a pattern image such as a matte pattern or decorative frame like an "image to be formed in protection coat image forming step" shown on the right side of step S203, which is different from that in step S202.

(Protection Coat Image Forming Step)

The protection coat image forming step as step S203 shown in FIG. 2 will be described below with reference to FIG. 1.

Figure 1:
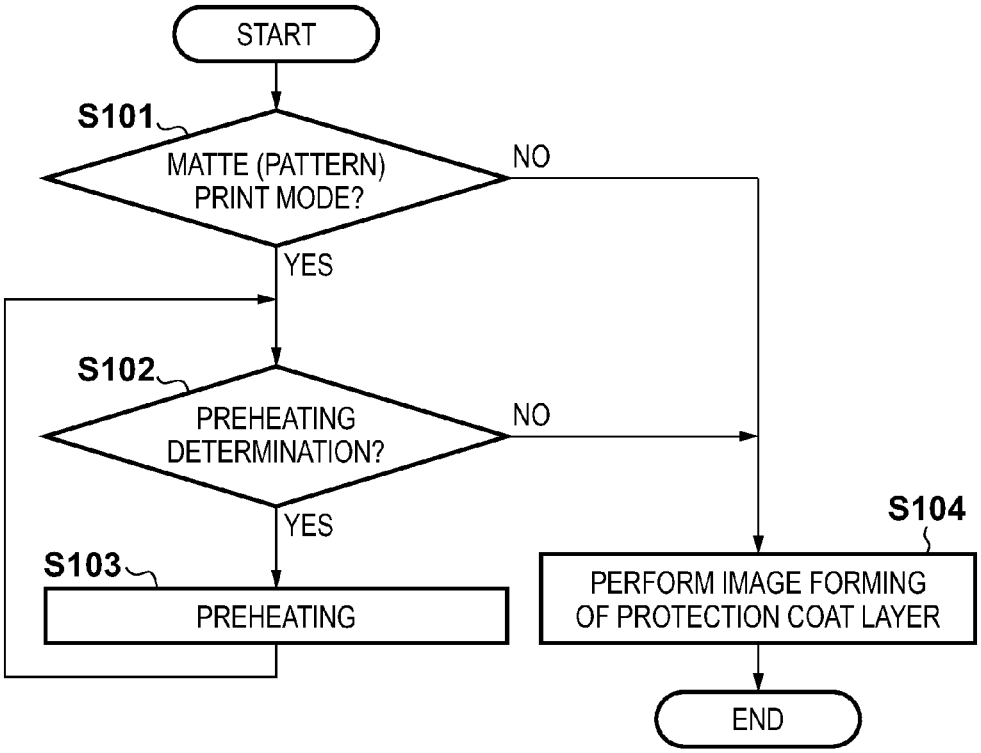
FIG. 1 is a flowchart showing a protection coat image forming operation by a thermal printer according to an embodiment.

Referring to FIG. 1, when a start command of the protection coat image forming step (step S203) is input to the printer main body 50, the main controller 601 determines a print mode (step S101). In this print mode determination step, the main controller 601 determines whether or not a print mode set in the printer is a matte (pattern) print mode.

If it is determined in step S101 that the set print mode is not the matte (pattern) print mode, (that is, if the set print ode is a glossy print mode), glossy image data is stored in the protection coat image buffer 611OC.

Then, the main controller 601 converts the data stored in the image buffer 611OC into thermal head driving data, as described above, and drives the thermal head driving circuit 613 and thermal head 4 based on this driving data, thus performing an image forming of the protection coat layer.

The gloss image does not have so-called image edges formed by discontinuously different tone data at adjacent pixels. For example, the glossy image includes an image formed by uniform tone data on the entire surface, an image on which tone data are continuously and smoothly changed with respect to respective pixels, and the like.

By preparing for a plurality of glossy image data, printed materials having various gloss properties (glossinesses and image clarities) are obtained.

On the other hand, if it is determined in step S101 that the set print mode is the matte (pattern) print mode, pattern image data such as a matte pattern or decorative frame is stored in the protection coat image buffer 611OC.

After that, the main controller 601 performs a determination process as to whether or not to perform a preheating process (step S102).

In step S102, the main controller 601 obtains information such as the printer internal temperature and thermal head temperature, and an elapse time from the beginning of the preheating determination process (step S102), and compares the obtained information with determination conditions (temperatures, times, and the like) stored in the ROM 606. Then, the main controller 601 determines necessity of the preheating process based on this comparison result.

As a result of determination in step S102, if it is determined that the preheating process is necessary, the main controller 601 performs the preheating process (step S103). Then, at a predetermined timing after the beginning of the preheating process, the process returns to step S102 to perform the preheating determination process again. The processes in steps S102 and S103 are repeated until it is determined that the preheating process is not necessary, and the preheating process is continued.

When it is determined in step S102 that the preheating process is not necessary, the process advances to step S104 to perform an image forming of the protection coat layer. At this time, the pattern image data such as a matte pattern or decorative frame has so-called image edges formed by discontinuously different tone data at adjacent pixels.

When an image forming of the image data having such image edges is performed in the matte (pattern) print mode, concaves/convexes are formed on the surface of a printed material at positions of the image edges. That is, since pixels which are adjacent to each other across an image edge have different heat generation amounts according to tone data, and a pixel of tone data corresponding to a higher density has a larger heat generation amount, a deformation amount of printing paper becomes larger, thus forming concaves/convexes at positions of the image edges.

As a deformation method of printing paper, in this embodiment, the printing paper is deformed to be concaved at a heat generation position of the thermal head 4.

The printing paper of this embodiment includes a receptive layer for receiving a dye of a dye-based ink sheet, a void layer required to improve heat efficiency, and a base member made up of, for example, natural paper required to keep rigidity, and a thermal deformation of the void layer especially acts in a direction to be largely concaved. Using such printing paper, concaves/convexes can be formed at the aforementioned image edge positions.

This embodiment uses the printing paper to which heat generated by the thermal head 4 acts in a direction to be concaved. However, the present invention is not limited to this. For example, the present invention is applicable to printing paper to which generated heat acts in a direction to be bulged (for example, printing paper manufactured by devising a receptive layer).

A heat generation amount difference becomes larger with increasing tone data difference (thermal head driving data difference) of pixels which are adjacent to each other across an image edge. As a result, a concave/convex step amount becomes larger, thus forming a clearer matte pattern or arbitrary pattern on the surface of a printed material.

Then, by preparing for a plurality of matte (pattern) print modes as pattern image data, printed materials having various matte properties or patterns can be obtained.

Note that after completion of the YMC image forming step (step S202) and protection coat image forming step (step S203), printing ends in a paper discharge step (step S204), and a printed material of a natural image on which a glossy, matte, or arbitrary pattern is formed is discharged from the printer main body 50.

<Mechanical Operation>

Operations of the mechanism in the print operation shown in FIG. 2 will be described below with reference to FIGS. 8 to 11.

FIG. 8 shows an operation state in the paper feed step (step S201) in FIG. 2.

Referring to FIG. 8, after the user presses the print start button 11, only an uppermost sheet of printing paper P stacked on the printing paper cassette 1 is separated and fed by the paper feed roller 2 and separation unit 3, and is conveyed to the thermal head 4 and platen roller 5.

Figure 9:
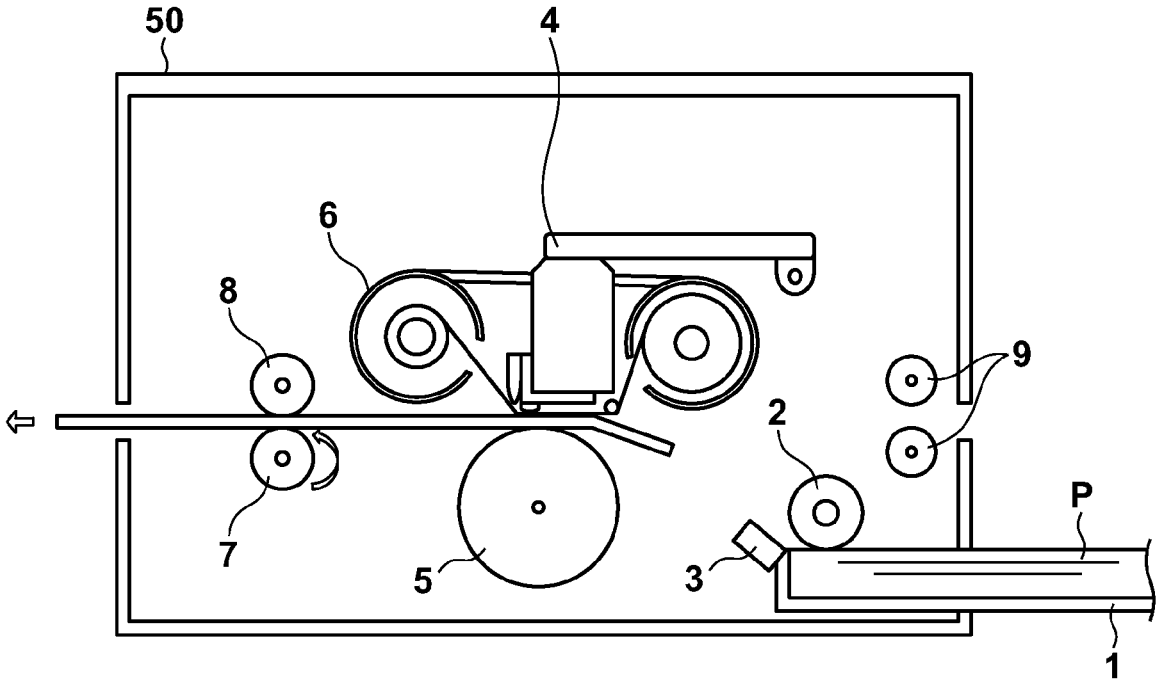
FIG. 9 is a view for explaining a paper discharge operation by the thermal printer according to the embodiment.
Figure 10:
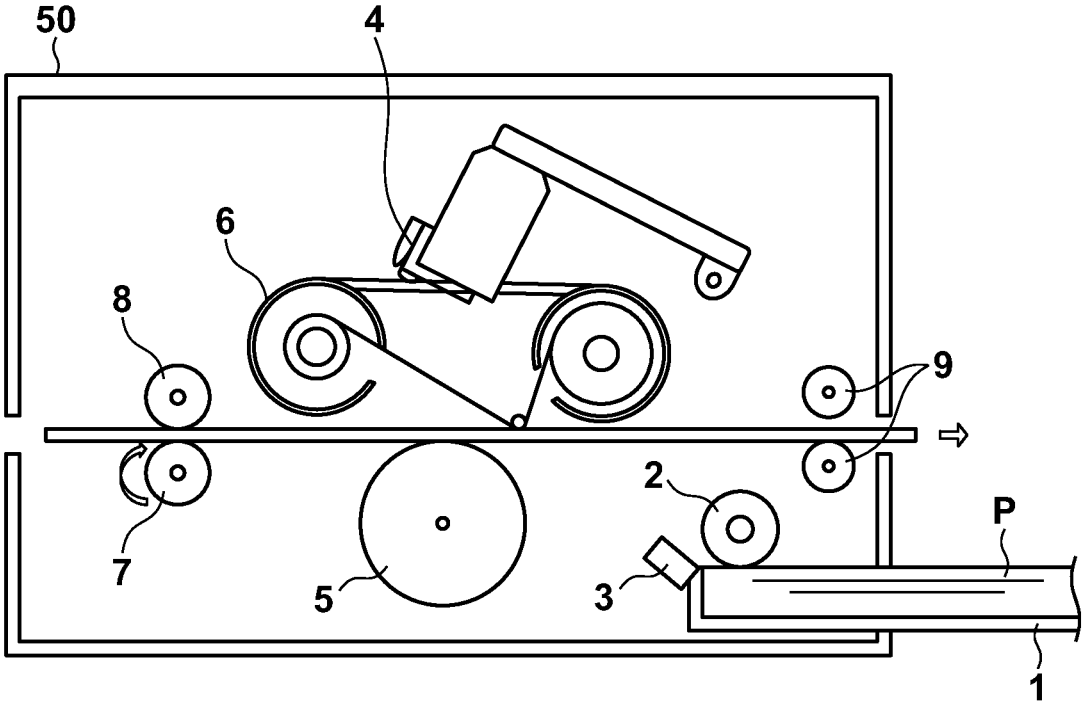
FIG. 10 is a view for explaining a print operation by the thermal printer according to the embodiment.

FIGS. 9 and 10 show operation states in the YMC image forming step (step S202) and protection coat image forming step (step S203) in FIG. 2.

Referring to FIG. 9, the ink sheet 6 and printing paper P are in pressure-contact with each other between the thermal head 4 and platen roller 5, and the printing paper P is conveyed in an image forming direction by the grip roller 7 and pinch roller 8 while thermally transferring inks on the ink sheet 6 onto the printing paper P by heat generated by the thermal head 4.

FIG. 10 shows a state in which an image forming of the first color of the ink sheet 6 including a plurality of colors (for example, yellow, magenta, cyan, and protection coat) is complete. Upon completion of an image forming of the first color, the pressure-contact of the thermal head 4 is released, and the grip roller 7 and pinch roller 8 are rotated in a direction opposite to that in the print operation, thus returning the printing paper P to the print start position.

After that, the same operations as in FIGS. 9 and 10 are repeated for the inks of the second and subsequent colors, thus performing an image forming. In this manner, three colors, that is, yellow, magenta, and cyan are overlaid to implement full-color image forming (YMC image forming).

After completion of the aforementioned full-color image forming (YMC image forming step), the process transits to the protection coat image forming step (step S203).

The image forming operation of the protection coat image forming step (step S203) is also the same as that of the YMC image forming step (step S202), and an image forming is performed by the operation shown in FIG. 9. The preheating process (step S103) in FIG. 1 is also performed in a state the ink sheet 6 and printing paper P are in pressure-contact with each other between the thermal head 4 and platen roller 5 shown in FIG. 9.

However, in the preheating process (step S103), the grip roller 7 and pinch roller 8 are not rotated, and the ink sheet 6 and printing paper P are in pressure-contact with each other between the thermal head 4 and platen roller 5 to avoid respective image forming regions.

<Description of Technical Problem>

The reason why the matte finish quality of a printed material is not stable, the thermal head temperature and ambient temperature (printer internal temperature) influence seriously, and a matte printed material cannot be obtained especially at a low temperature in the conventional printer will be described below with reference to FIGS. 13A to 13D.

FIGS. 13A to 13D show states of a printed material for thermal head driving data (or the number of thermal head driving pulses) in a protection coat image forming (OP image forming) and YMC image forming.

FIGS. 13A and 13C show states of a printed material for thermal head driving data at a certain thermal head temperature and ambient temperature in association with an OP image forming and YMC image forming.

On the other hand, FIGS. 13B and 13D show states of a printed material for thermal head driving data at a temperature lower than FIGS. 13A and 13C.

Hl_G and Sd_G in FIGS. 13A and 13B are Hl and Sd in an OP image forming operation in the glossy print mode.

Reference symbol Hl denotes a minimum setting value (the minimum number of driving pulses) of the thermal head driving data; and Sd, a settable data range (a range of the number of driving pulses which can be set) of the thermal head driving data.

That is, this means that the thermal head driving data in the OP image forming operation in the glossy print mode can be set within a range of Hl_G to Hl_G+Sd_G.

The thermal head driving data will be described in more detail below. Letting X be image data at an arbitrary pixel in an image to be printed, thermal head driving data of the image data X can be calculated using Hl and Sd by:

$$(\text{Thermal head driving data})=f(X)\times Sd+Hl$$

where f(X): an LUT (lookup table), $0 \le f(X) \le 1$, f(X)=1 when X is image data which represents a maximum density f(X)=0 when X is image data which represents a minimum density By performing an image forming by controlling the heat generation members of the thermal head to generate heat using the thermal head driving data converted by the above equation, a printed material on which an image is printed can be obtained.

As shown in FIGS. 13A and 13B, Hl_G and Sd_G are set within a range indicating a glossy range except for a protection coat layer non-forming region and thermal deformation region. By performing an image forming of a protection coat layer by driving the thermal head using the thermal head driving data within the range set by such Hl_G and Sd_G, a printed material having glossiness can be obtained.

Hl_SG and Sd_SG in FIG. 13A correspond to Hl and Sd in an OP image forming operation upon performing printing in the matte (pattern) print mode.

Hl_SG and Sd_SG are set so that a value (that is, an image forming energy) of the thermal head driving data is larger than a glossy region, and a thermal deformation region is included. By performing an image forming using this thermal head driving data including the thermal deformation region, a desired matte pattern or decorative frame can be formed on the surface of a printed material.

Hl_C and Sd_C in FIGS. 13C and 13D are Hl and Sd in a YMC image forming operation, and are set to obtain a color region indicating a desired density.

Setting values of Hl_C and Sd_C are variable for respective temperatures, so that a desired density can be obtained under every temperature environments (under low to high temperature environments), as shown in FIGS. 13C and 13D.

FIGS. 14A to 14C are tables for explaining the aforementioned mechanism, and FIG. 14A shows a temperature correction table used in a YMC image forming operation.

This temperature correction table stores pieces of information of Hl_C and Sd_C on a matrix which represents the relationship between a printer internal temperature Tenv and thermal head temperature Thead. Then, various temperatures are detected, and Hl_C and Sd_C are obtained from the temperature correction table pre-stored in the storage unit of the printer based on the detection result and are set in the printer, thus performing an image forming. Thus, a desired density can be obtained under every temperature environments.

Such mechanism is applied to the glossy print mode, and a temperature correction table shown in FIG. 14B is used in an OP image forming operation.

On the other hand, setting values of the thermal head driving data in an OP image forming operation in the matte (pattern) print mode which requires a thermal deformation region, are larger than other image printing setting values, and require a higher application energy, as can be seen from FIGS. 13A and 13C. That is, the conventional printer falls into a situation in which Hl_SG and Sd_SG that can attain a matte finish cannot be set under a low-temperature environment shown in FIG. 13B.

That is, as shown in FIG. 14C, in the matte (pattern) print mode, a problem that the temperature correction table cannot be set especially under a low-temperature environment, and a matte (pattern) printed material cannot be obtained.

In order to avoid this problem, a method of performing an image forming by increasing an application energy (for example, by increasing a thermal head voltage) is known.

However, an ink ribbon is wrinkled due to a thermal damage caused by an increase in thermal head voltage, traces of wrinkles appear a formed image, and a wrinkle-like concave/convex pattern is formed on the protection coat layer of a printed material, thus considerably deteriorating image forming quality.

The present invention has been made to solve the aforementioned problems, and can form stable concaves/convexes on a printed material under every temperature environments. Thus, a printed material indicating satisfactory half-gloss (or an arbitrary concave/convex pattern based on arbitrary image data) can be stably obtained.

Furthermore, the single thermal printer can stably obtain a glossy or matte printed material under every temperature environments.

<Protection Coat Image Forming>

The protection coat image forming step of this embodiment will be described below.

In this embodiment, necessity of a preheating process, a preheating temperature (threshold temperature), a preheating time, and the like are determined using the detection results of the internal temperature sensor 604 and thermal head sensor 605.

In this embodiment, various print modes which can form various concave/convex states on the surface of a printed material, and allow the user to arbitrarily select light reflection states are prepared. That is, when the user arbitrarily selects a print mode, a glossy printed material (glossy print mode), matte printed material (matte print mode), or a printed material on which a pattern such as a decorative frame is formed (pattern print mode) can be obtained.

Then, the control programs and image data required to obtain these printed materials are stored in the ROM 606.

The user designates a print mode for the printer 100 at least before an image forming of the protection coat layer (normally, before pressing of the print start button 11).

In this embodiment, a print mode select button 13 shown in FIG. 5 is arranged as a user interface, and every time the user presses the select button 13, a print mode is switched, and is displayed on the display unit 12.

In this embodiment, the select buttons 13 are arranged at two positions. A difference between these two select buttons 13 is that switching orders of print modes every time the corresponding select buttons 13 are pressed are opposite to each other.

When the two select buttons 13 are simultaneously kept held down for several sec or longer (3 sec or longer in this embodiment), the print mode displayed on the display unit 12 can be set in the printer 100.

The user interface is not limited to the select buttons. For example, selectable print modes may be displayed on a liquid display device, and the user may select a desired mode from these modes (for example, a touch panel type selection unit).

<Preheating Determination Process>

Details of the preheating determination process in the protection coat image forming operation of this embodiment will be described below with reference to FIG. 3.

Figure 3:
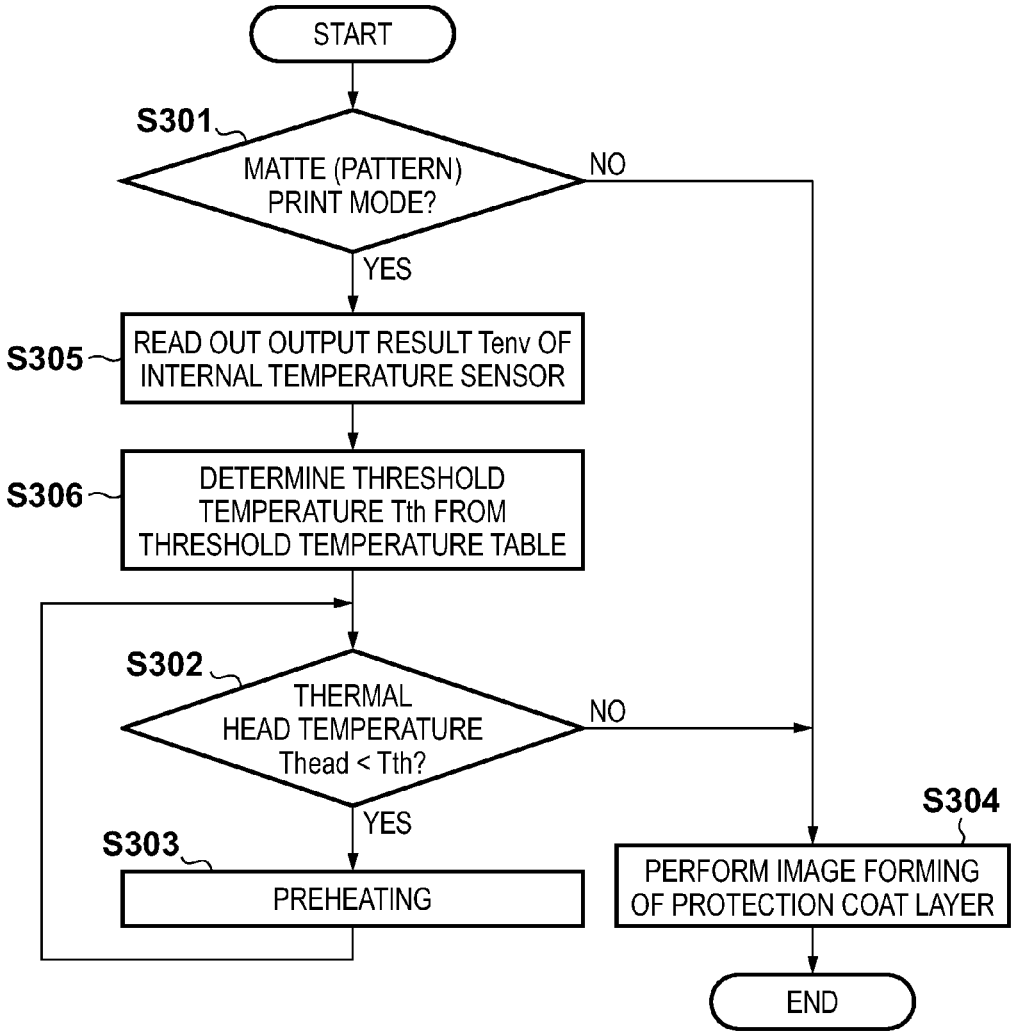
FIG. 3 is a flowchart showing details of a preheating determination process in the protection coat image forming operation according to the embodiment.

Note that the processing shown in FIG. 3 can be implemented when the main controller 601 extracts a control program stored in the ROM 606 onto the work area of the RAM 607, and executes the extracted program.

Referring to FIG. 3, the main controller 601 determines in step 5301 whether or not the user selects the matte (pattern) print mode. The matte (pattern) print mode in this case is a print mode other than the glossy print mode, and is selected when a pattern such as a matte pattern or decorative frame is to be printed.

As described above, a print mode can be determined based on image data. That is, when an image forming of the protection coat layer is performed using image data having image edges, the matte (pattern) print mode is determined; otherwise, the glossy print mode is determined.

Therefore, in case of a printer having a function of allowing the user to input an arbitrary image and performing an image forming of the protection coat layer, an edge detection unit may detect image edges of the input image, and the print mode may be automatically determined using the detection result.

If it is determined in step S301 that the user does not select the matte (pattern) print mode, the process advances to step S304. In step S304, as described above using FIG. 1, glossy image data stored in the image buffer 611OC is converted into thermal head driving data, and the thermal head 4 is driven using this data, thereby generating a glossy printed material.

On the other hand, if it is determined in step S301 that the user selects the matte (pattern) print mode, the process advances to step S305 to obtain an output result Tenv of the internal temperature sensor 604.

After that, in step S306, the main controller 601 determines a threshold temperature Tth from the output result Tenv of the internal temperature sensor 604 and a threshold temperature table stored in the ROM 606.

The threshold temperature Tth is used as a criterion for determining whether or not the preheating process (step S303) is to be performed, and is a so-called preheating temperature.

In step S302, the main controller 601 compares the thermal head temperature Thead with the threshold temperature Tth. If it is determined that the thermal head temperature is less than the threshold temperature (Thead<Tth), the process advances to step S303 to perform the preheating process. Then, steps S302 and S303 are repeated at a predetermined timing, thus continuing the preheating process until the thermal head temperature becomes equal to or higher than the threshold temperature (Thead≥Tth). That is, the threshold temperature Tth is used as a criterion for determining in step S302 whether or not the preheating process is to be performed.

The aforementioned threshold temperature table will be described below with reference to FIG. 4.

Figure 7A:
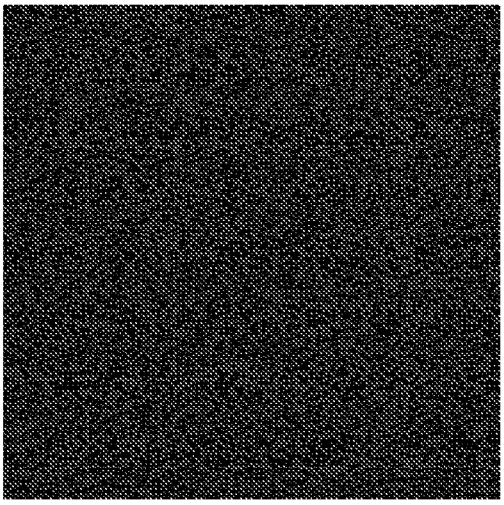
FIGS. 7A and 7B are views showing examples of matte patterns formed in a protection coat image forming step according to the embodiment.
Figure 7B:
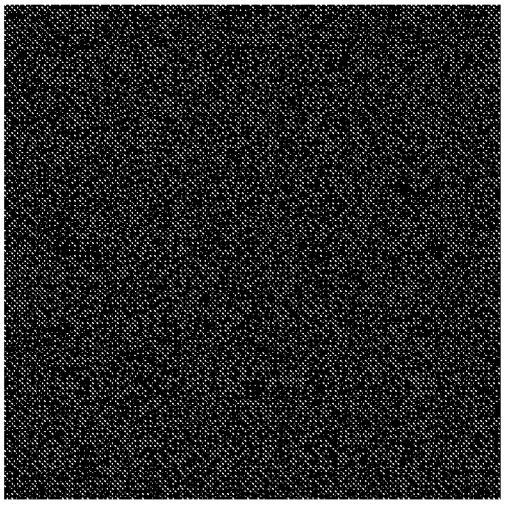

FIG. 4 shows an example of a threshold temperature table for two types of matte patterns shown in FIGS. 7A and 7B. In this embodiment, image data of these two types of matte patterns and the threshold temperature table are stored in the ROM 606.

Also, as shown in FIG. 4, three types of matte states can be set for each matte pattern.

This matte state depends on the threshold temperature Tth. A concave/convex step amount on the surface of a printed material becomes larger as the state has the higher threshold temperature Tth, irregular reflection components of reflected light increase, and the matte state looks "sharp".

Conversely, when the threshold temperature Tth is low, a concave/convex step amount on the surface of a printed material becomes small, irregular reflection components of reflected light decrease, and the matte state looks "vague".

In this embodiment, three types of matte states, that is, the states "sharp" and "vague" described above and a state "medium", can be set for each matte pattern, and a total of six types of matte states can be realized.

Note that in this embodiment, two types of matte patterns and three types of matte states for each pattern are prepared. However, the present invention is not limited to this. Of course, the number of types of patterns may be increased, or the number of types of matte states may be increased by further segmenting the matte states.

As image data, the present invention is not limited to the matte patterns, but an arbitrary pattern such as a decorative frame may be used.

The threshold temperature Tth which influences the appearance of each matte state described above depends on the internal temperature Tenv of the printer main body 50. That is, in order to realize a desired matte state, the threshold temperature Tth is required to be changed for each internal temperature Tenv.

As shown in FIG. 4, when the internal temperature Tenv is low, the high threshold temperature Tth is required to be set; when the internal temperature Tenv is high, the lower threshold temperature Tth is required to be set or the need for the preheating process has to be obviated.

A table including the threshold temperature Tth for the internal temperature Tenv or necessity of the preheating process for each matte state is stored as the threshold temperature table. This threshold temperature table is stored in advance in the ROM 606, and is used in step S306 in FIG. 3.

When "preheating not required" is set in the threshold temperature table, an image forming of the protection coat layer is performed using a temperature correction table stored in the ROM 606 from the detection results of the internal temperature Tenv and thermal head temperature Thead at that time.

Figure 12:
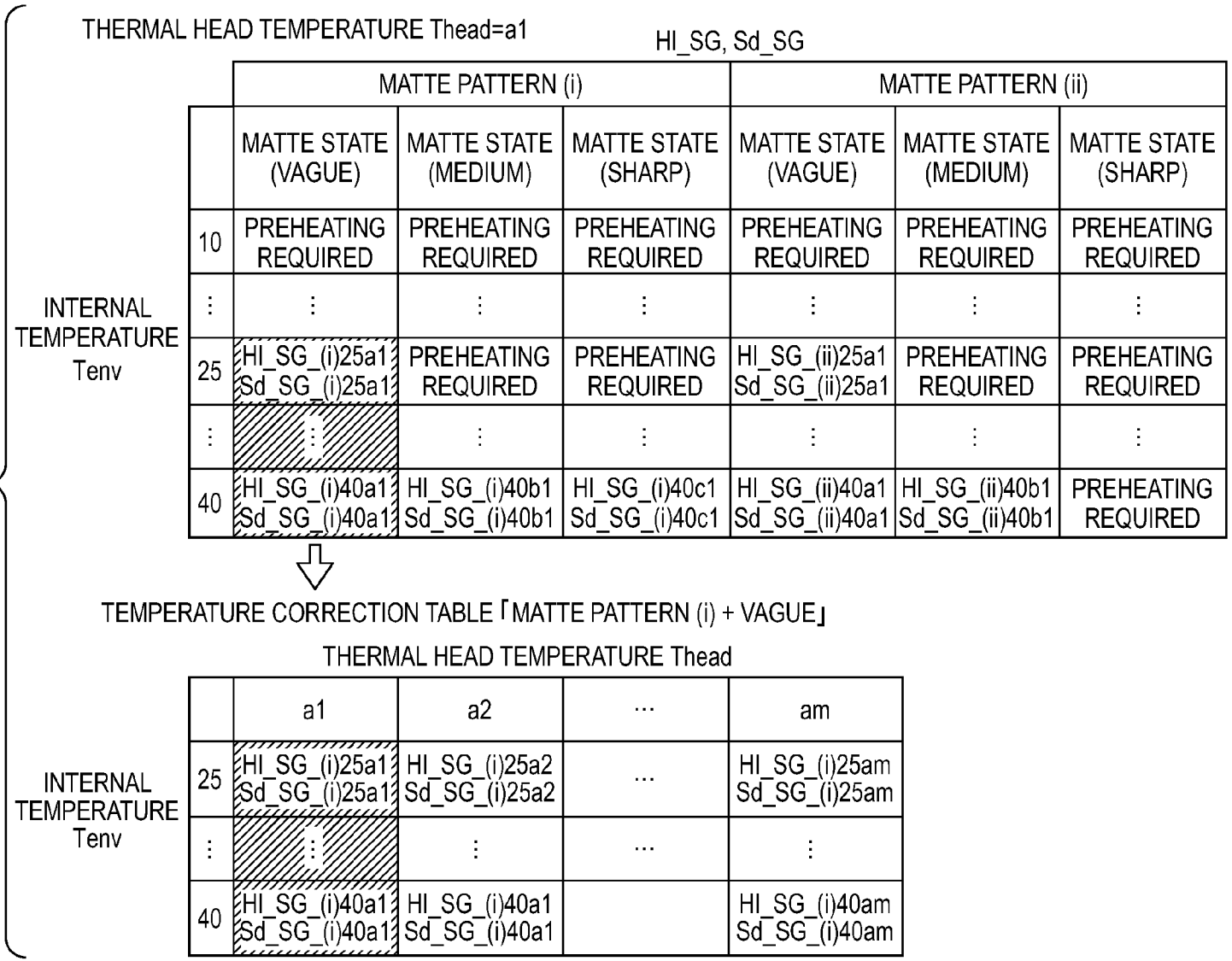
FIG. 12 shows examples of temperature correction tables in a protection coat image forming.

That is, temperature correction values Hl_SG and Sd_SG depending on the internal temperature Tenv and thermal head temperature Thead shown in FIG. 12 are obtained, and thermal head driving data is calculated from these values, thus driving the thermal head 4.

An upper table in FIG. 12 is that expressed in correspondence with the threshold temperature table shown in FIG. 4, and is that when the thermal head temperature Thead=a1. In fields other than "preheating required", temperature correction values Hl_SG and Sd_SG in respective matte states are described.

Then, a lower table in FIG. 12 is a temperature correction table used when an image forming of the protection coat layer is performed in the matte (pattern) print mode of a matte state [matte pattern 1+"vague"].

Such temperature correction tables are respectively prepared for the remaining five types of matte states. When an image forming of the protection coat layer is performed using this temperature correction table, even when "preheating not required" is determined in the threshold temperature table shown in FIG. 4, a printed material of a desired matte state can be stably obtained.

In this way, a printed material of a stable matte state can be obtained under every temperature environments (under low- to high-temperature environments) as printer operation environments, thus ending the protection coat image forming step (step S203) in FIG. 2.

Figure 11:
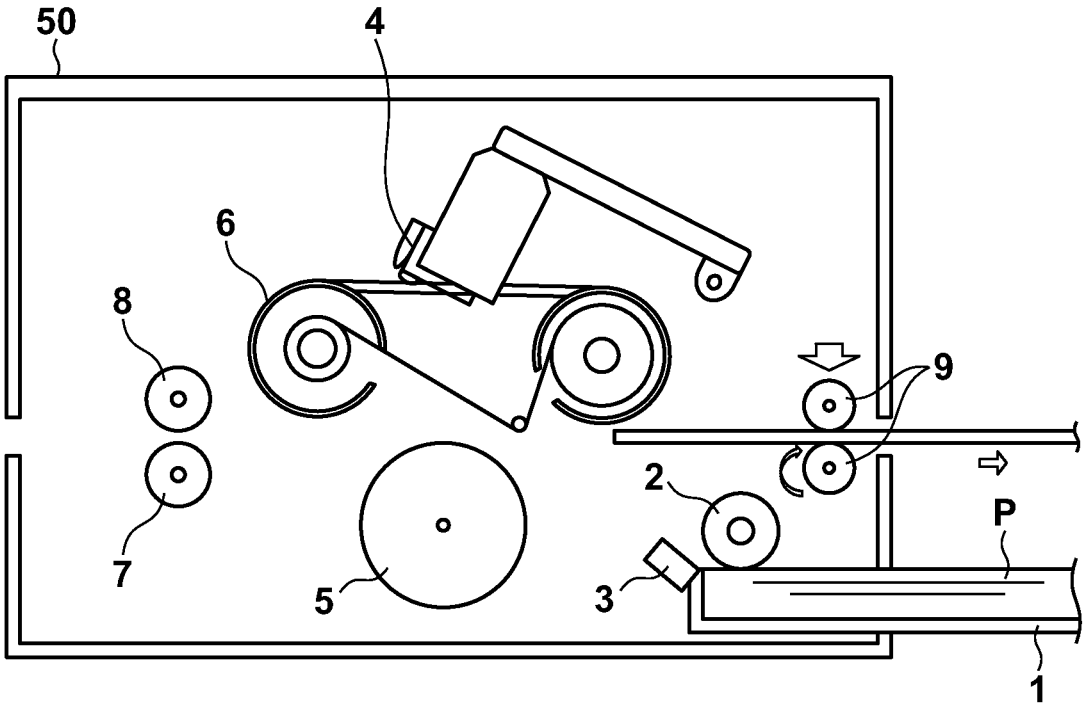
FIG. 11 is a view for explaining a feedback operation by the thermal printer according to the embodiment.

FIG. 11 shows a state of the paper discharge step (step 5204) in FIG. 2. After completion of an image forming, a printed material is clamped by the paper discharge roller pair 9, and a lower roller of the paper discharge roller pair 9 is rotated in a paper discharge direction, thereby discharging the printed material from a paper discharge port, and ending the print operation.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-021341, filed Feb. 2, 2012, which is hereby incorporated by reference herein in its entirety.

What is claimed is:

1. A thermal printer for printing an image by transferring an ink onto a printing medium, comprising:

a print unit configured to print an image by transferring the ink onto the printing medium, and to form a protection coat layer on the printed image;

a designation unit configured to designate a glossy print mode or a matte print mode as a print mode required to form the protection coat layer; and a control unit configured to control said print unit according to the print mode designated by said designation unit, wherein when said designation unit designates the glossy print mode, said control unit controls said print unit to execute printing of the protection coat layer without performing any preheating process, and when said designation unit designates the matte print mode, said control unit controls said print unit to perform the preheating process, and to then execute printing of the protection coat layer.

2. The printer according to claim 1, wherein the matte print mode further includes a plurality of matte patterns, and said control unit determines at least one of necessity of the preheating process, a preheating temperature, and a preheating time in accordance with a matte pattern designated by said designation unit from the plurality of matte patterns.

3. The printer according to claim 1, further comprising a detection unit configured to detect a temperature of a thermal head included in said print unit, wherein in the matte print mode, said control unit controls said print unit to perform the preheating process until the temperature of the thermal head detected by said detection unit becomes not less than a threshold temperature, and to then execute printing of the protection coat layer.

4. The printer according to claim 3, further comprising an obtaining unit configured to obtain an internal temperature of said thermal printer, wherein in the matte print mode, said control unit determines the threshold temperature according to the internal temperature obtained by the obtaining unit.

5. The printer according to claim 4, further comprising:

a plurality of tables which define relationships between the internal temperature and the threshold temperature; and a storage unit configured to store the plurality of tables, wherein the plurality of tables define relationships between the internal temperature and information pertaining to the threshold temperature or necessity of the preheating process, and when the preheating process is not required, said control unit determines driving data of a thermal head using a correction table which defines a relationship between the internal temperature and a temperature of the thermal head, and controls said print unit to drive the thermal head using the determined driving data to transfer the protection coat layer.

6. The printer according to claim 1, further comprising:

an edge detection unit configured to detect edges at which tone data at adjacent pixels are discontinuously different upon transferring the protection coat layer using a matte pattern in the matte print mode; and a determination unit configured to determine necessity of the preheating process in accordance with a detection result of said edge detection unit.

7. A protection coat print method in a thermal printer, which forms an image by transferring an ink onto a printing medium, and forms a protection coat layer on the printed image, comprising:

a designation step of designating a glossy print mode or a matte print mode as a print mode required to form the protection coat layer; and a control step of controlling a thermal head according to the print mode designated in the designation step, wherein in the control step, when the glossy print mode is designated in the designation step, the thermal head is controlled to execute printing of the protection coat layer without performing any preheating process, and when the matte print mode is designated in the designation step, the thermal head is controlled to perform the preheating process, and to then execute printing of the protection coat layer.

8. A computer-readable storage medium storing a program for causing a computer to execute the printing method according to claim 7.

* * * * *